US005323574A

United States Patent [19]

Ahern

[11] Patent Number: 5,323,574

[45] Date of Patent: Jun. 28, 1994

[54] FLOOR SYSTEM WITH LOW RESISTANCE TO IMPACT

[75] Inventor: William W. Ahern, Belmont, Mass.

[73] Assignee: Electronic Space Systems Corporation, Concord, Mass.

[21] Appl. No.: 681,570

[22] Filed: Apr. 5, 1991

[51] Int. Cl.[5] ..... E04B 1/00

[52] U.S. Cl. ..... 52/98; 52/110; 52/40

[58] Field of Search ..... 52/98, 99, 100, 110, 52/194, 40, 79.1, 79.4, 79.6, 87, 807, 126.5, 263

[56] References Cited

U.S. PATENT DOCUMENTS

| | | | |
|---|---|---|---|
| 411,432 | 9/1889 | Gates | 52/40 |
| 572,995 | 12/1896 | Jackson et al. | 52/40 X |
| 2,923,305 | 2/1960 | Cline . | |
| 3,065,506 | 11/1962 | Tremer | 52/263 |
| 3,199,257 | 8/1965 | Spiselman et al. | 52/263 X |
| 4,112,634 | 9/1978 | Bissinger . | |
| 4,438,610 | 3/1984 | Fifer | 52/263 |
| 4,653,238 | 3/1987 | Berman . | |
| 4,805,356 | 2/1989 | Feisst . | |
| 4,835,924 | 6/1989 | Blacklin et al. | 52/263 |
| 4,848,046 | 7/1989 | Wallhead . | |
| 4,922,670 | 5/1990 | Naka et al. | 52/263 X |
| 5,117,596 | 6/1992 | Leslie et al. | 52/79.4 X |

FOREIGN PATENT DOCUMENTS

| | | | |
|---|---|---|---|
| 0224252 | 5/1958 | Australia | 52/807 |

*Primary Examiner*—Carl D. Friedman
*Assistant Examiner*—Robert Canfield
*Attorney, Agent, or Firm*—Wolf, Greenfield & Sacks

[57] ABSTRACT

A floor system with low resistance to impact has loosely connected separate light weight components forming a support frame upon which a plurality of floor panels is disposed. The support frame is comprised of a plurality of support elements which, in turn, are constructed of a plurality of support members each having a maximum dimension of at most a predetermined fixed size. The plurality of floor panels is disposed onto of and supported by the support elements. The floor panels preferably have mating beveled edges, which bevels facilitate the panels in kicking up and over each other upon substantially horizontal impact. The position of the floor panels is relative to the support elements is loosely maintained by cooperating short pins and holes. In one aspect of the invention, the support elements are spaced apart and are not connected to each other for support. In another aspect, the support elements are interconnected and supported by a supporting structure. Given this construction, a floor system can support substantially vertical loads of personnel and equipment but break apart into pieces having a maximum dimension of at most a predetermined, fixed size when subjected to substantially horizontal impact loads.

23 Claims, 6 Drawing Sheets

FLOOR SYSTEM WITH LOW RESISTANCE TO IMPACT

RELATED APPLICATIONS

The following two patent applications are closely related hereto:

1. "Frangible Panel for a Frangible Enclosure with Low Resistance to Impact," Ser. No. 07/681,569, filed Apr. 5, 1991, in the name of William Ahern; and 2. "Frangible Enclosure with Low Resistance to Impact," Ser. No. 076/681,572, filed Apr. 5, 1991, also in the name of William Ahern;

Both of their disclosures are hereby incorporated by reference.

FIELD OF THE INVENTION

This invention concerns a floor system for use in a frangible enclosure, such as an enclosure for an antenna, which has low resistance to localized impact while having high resistance to strong distributed loads, such as wind loads.

BACKGROUND OF THE INVENTION

The Federal Aviation Administration (FAA) of the U.S. Government and other bodies have requested designs for enclosures for various types of antennas to be used at airports. An important requirement for these enclosures is the ability to withstand repeated jet blasts of 150 m.p.h. from aircraft and sustained winds. A jet blast may have a duration of up to one minute, may be from an angle up to 15° from horizontal and may occur up too 500 times per month. However the enclosure must shatter on impact by a colliding light aircraft traveling at about 75 m.p.h. Moreover, only minimum damage upon the aircraft can be inflicted. To this end, upon impact the enclosure must shatter into small pieces e.g., pieces having a maximum span of at most four feet. These criteria result from a plan to construct antenna towers and other structures very close to and along airport runways, such as for use with improved instrument landing systems. The location of these structures necessitates the frangibility of the enclosures. I am currently unaware of any enclosures which are specifically designed to be frangible and to shatter upon impact yet withstand large distributed loads.

A radar antenna in such an enclosure must be accessible by installers and maintenance personnel, thus, a floor system is required therein to allow personnel to work inside the enclosure. Such a floor system needs to support primarily vertical loads of personnel and equipment but also needs to break up easily into separate parts when subjected to impact loads from a collision. These impact loads normally involve large horizontally-directed forces. A typical load of personnel and equipment on a floor which must be supported by the floor system is about 100 pounds per square foot in the vertical direction A substantially horizontal impact load of 700 ft./lbs. per breakage area must also cause failure of the floor system. I am currently unaware of any such frangible floor systems.

Accordingly it is an object of the present invention to provide a floor system for a frangible enclosure such as may be used to house an antenna. The floor system must provide low resistance to localized impact, but have high resistance to distributed loads such as those from wind. More particularly, it is an object of the invention to provide a floor system that will withstand primarily vertical loads of personnel and equipment, but shatter on impact from a colliding light aircraft, with the objective of minimizing damage to the aircraft.

Another object of the present invention is to provide a floor system for a frangible enclosure which upon localized impact separates into pieces having a dimension of at most four feet.

A further object of the present invention is to provide a floor system for a frangible enclosure that is easily fabricated, transported and handled.

SUMMARY OF THE INVENTION

In one embodiment of the invention the structure of the floor system is an enclosure having a base, wherein the support elements are supported by the base of the enclosure. The support elements are disposed therein in a spaced apart relationship in at least one dimension and are not connected to each other for support. At least selected adjacent pairs of said floor panels have smoothly mating edges, which edges have at least one beveled portion smoothly mating against the adjacent floor panel of the pair. Furthermore, selected adjacent pairs of the support members also have smoothly mating edges, which edges each have at least one beveled portion smoothly mating against the adjacent support member of the pair. Pluralities of support members are associated by means comprised of a layer of laminate material. The position of the floor panels relative to the support element is loosely maintained by a short pin on the panel which is received by a hole in the support elements. Alternatively, the pins could be located in the support elements and engage with a hole in the floor panels.

In another embodiment of the invention, the floor system is provided for a structure having a plurality of support means, and selected support elements are attached to the support means. Remaining support elements are attached to the select support elements to form a support frame. The floor panels of this embodiment are similarly provided with smoothly mating edges, which may be beveled. The position of the floor panels relative to the support elements is maintained in a similar manner as well. Pluralities of support members are associated by means comprising at least one connection plate of which one end is attached to a support member by a shear pin, and of which an opposite end is attached to the associated support member by another shear pin.

BRIEF DESCRIPTION OF THE DRAWING

Numerous other objects, features and advantages of the invention should be apparent when the following detailed description is read in conjunction with the accompanying drawing in which.

DETAILED DESCRIPTION

Figure 1:
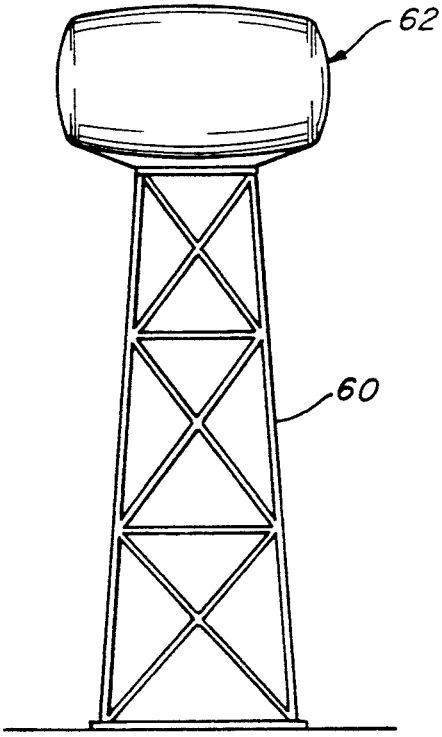
FIG. 1 is an elevational view of an enclosure for an antenna on an open tower, illustrating an embodiment of the present invention.
Figure 2:
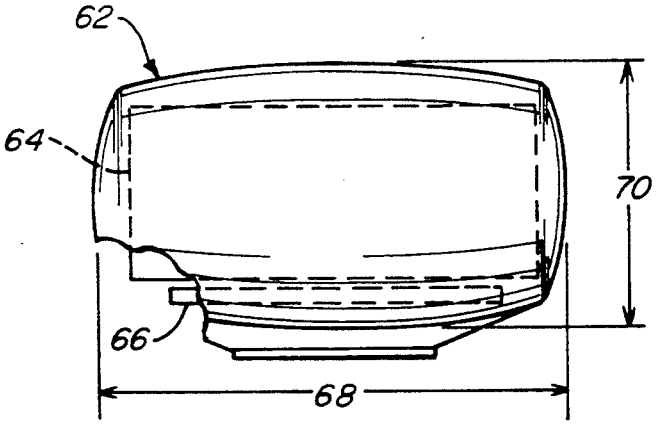
FIG. 2 is a front elevational view of the enclosure as shown in FIG. 1, showing the enclosed antenna and floor system in phantom.
Figure 3:
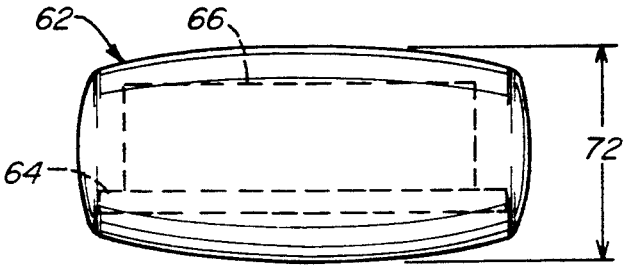
FIG. 3 is a top plan view of the enclosure shown in FIGS. 1 and 2.

FIGS. 1–3 illustrate an antenna tower supporting a frangible enclosure of the type in which it is contemplated that the present invention may be used. The floor system may be used in other, varied environments other than antenna enclosure, such as equipment storage areas.

A radar antenna, supported on an open tower 60, or other structure can be protected by an enclosure 62. The antenna 64 (shown in phantom, FIG. 2) is supported by the tower 60 and is accessible by maintenance personnel. Personnel are supported by the floor 66 (also shown in phantom). The floor in the frangible enclosure does not support the antenna 64; the antenna usually is fixed on and supported directly by the tower 60.

An enclosure for an azimuth antenna, as illustrated in FIG. 2, typically might have a length 68 of about 14 feet, and a height 70 of about 7.5 feet. Dimensions will vary for other types of enclosures. The enclosure 62, illustrated in FIG. 3, also has a typical width 72 of about six feet. The floor 66 (shown in phantom) substantially covers the base of the enclosure 62, and the antenna 64 is normally proximate to one side of the enclosure 62.

As a general example, there are two primary types of antennas for which there may be provided an enclosure and a floor system according to the present invention: namely an azimuth antenna (as illustrated) and an elevation antenna (the same but rotated 90°). Other enclosures can also be provided with such a floor system.

Figure 4:
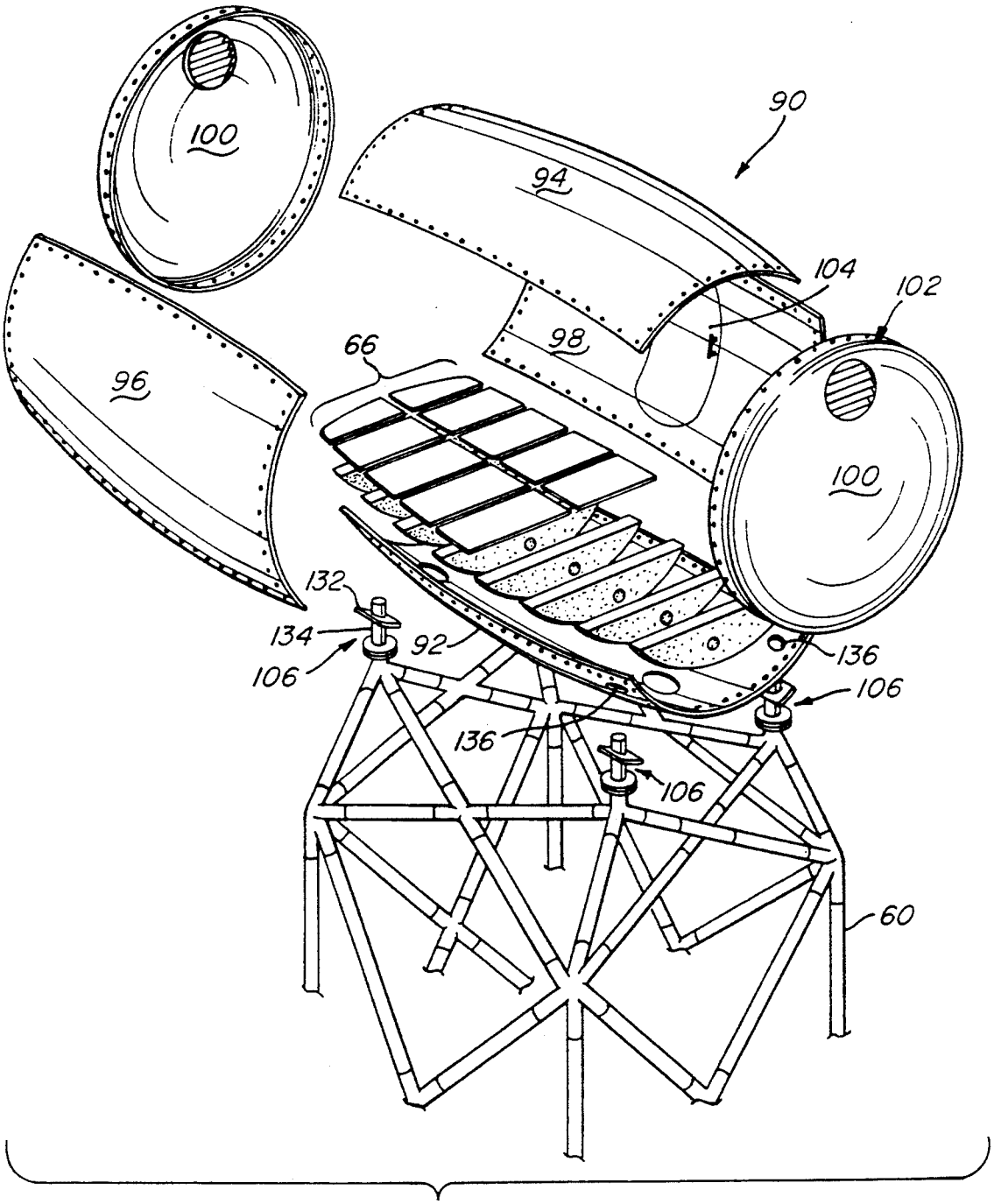
FIG. 4 is an exploded isometric view of an enclosure for an azimuth antenna

FIG. 4 is an exploded isometric view of an enclosure for an azimuth antenna as previously described in connection with FIGS. 1–3. Elevation antenna enclosures will have substantially similar construction. The enclosure 90 is comprised of a plurality of panels, including end panels 100, top panel 94, side panel 96, door panel 98 and base panel 92 which are interconnected to form a housing. The housing has a curvature, such as a double curvature, whereby distributed loads primarily are resisted by axial stresses in the housing. The panels of the enclosure are preferably weakened to make the enclosure frangible, for example by forming a weakened portion in the panel. The resistance of the panel to flexural loads is reduced at the weakened portion. When the weakened portions are spaced at a suitable dimension, the enclosure breaks apart proximate the weakened portions, upon large impact loads, so that each piece has a size less than a predetermined maximum size. More details concerning how this enclosure may be made and used are found in copending application Ser. No. 07/681,569, which is hereby incorporated by reference. The enclosure surrounds an antenna (not shown) and a floor 66. The enclosure is connected to the tower 60 via a connection means 106 which includes a plurality of support plates 132 and associated connection stubs 134. Each stub 134 is inserted through a corresponding hole 136 in the base panel 92. The support plates 132 distribute the load of the enclosure around the hole 136 in the base panel and onto the tower 60. A suitable securing member (not shown) can secure the enclosure 90 to the support plate 132. An antenna (not shown) can then be attached to stub 134. In this configuration, the antenna is supported only by the tower 60 and does not cause additional loading on the enclosure 90.

Figure 5:
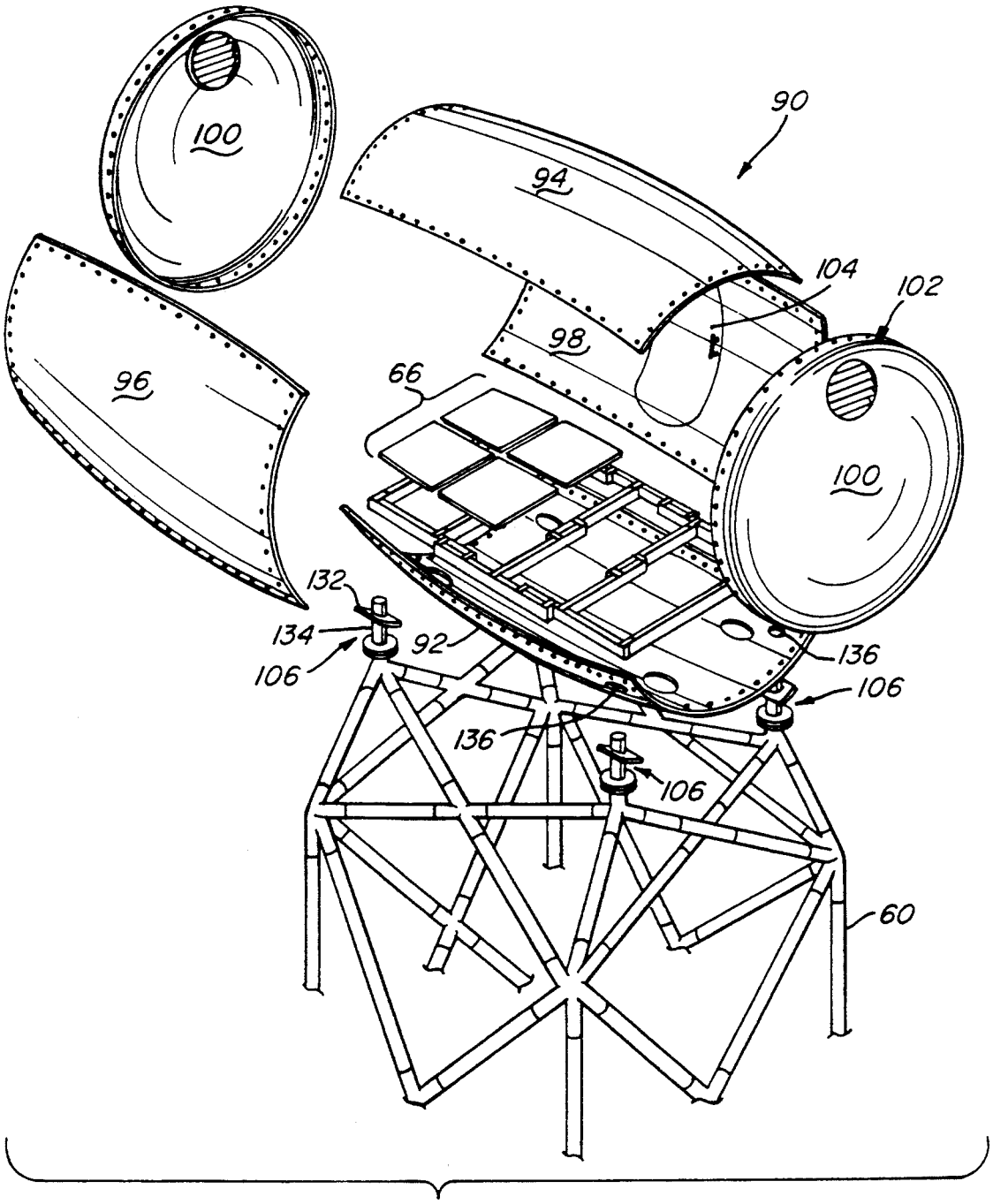
FIG. 5 is another exploded isometric view of an enclosure for an azimuth antenna.
Figure 6:
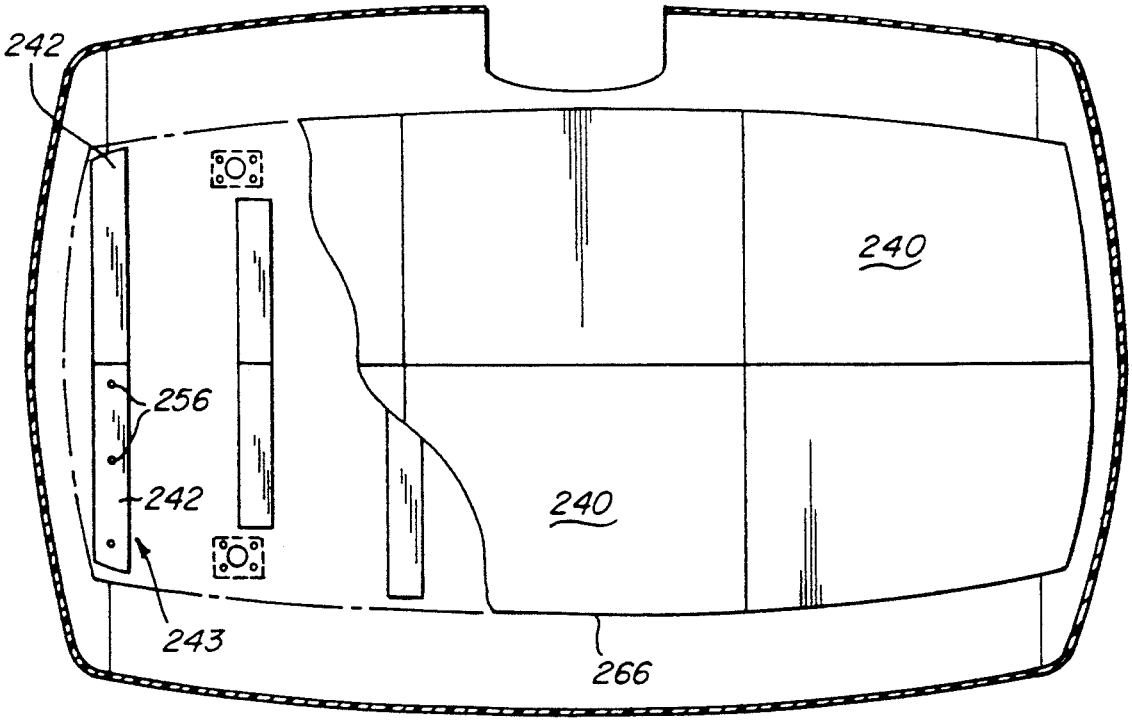
FIG. 6 is a cut-away, floor plan of an enclosure for an azimuth antenna.

FIG. 5 is another exploded isometric view of an enclosure for an azimuth antenna as previously described in connection with FIGS. 1–3. An alternate embodiment of the floor system 66 is illustrated. In this embodiment, the floor beams are also supported by the connection stub 134.

The details of the construction of the floor system 66 will now be described further in connection with FIGS. 6–11.

The floor system 66 is designed as an assembly of separate lightweight components that need only be loosely linked to each other. This system need only be loosely connected to the inside surface of the enclosure, as well. Together, the assembly of components forms a system sufficient to support the primarily vertical loads of personnel and equipment that will occupy the enclosure, but one that will break up easily into separate parts under the generally horizontal impact loads.

Figure 7:
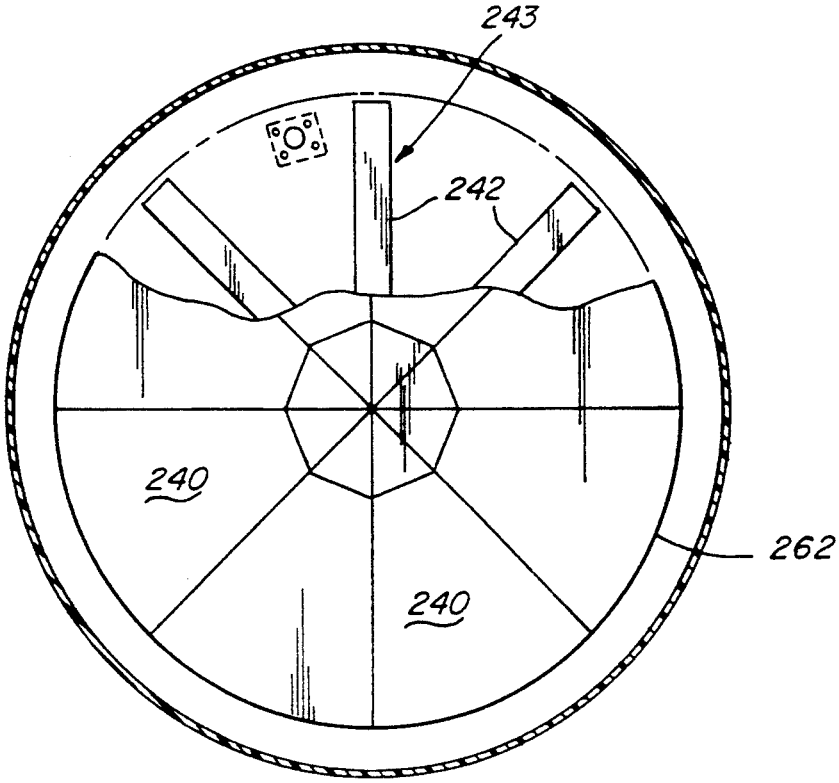
FIG. 7 is a cut-away, floor plan of an enclosure for an elevation antenna

One embodiment of the floor system shown in FIGS. 6 through 9 comprises a set of thin floor panels 240 resting on light support members 242. The support members are combined onto sets, each set forming a support element 243. The support elements 243 are separated by at most the width of a floor panel 240. Alternatively, the support elements 243 can form a star configuration as shown in FIG. 7. The support members 242, are preferably made of low density, light weight rigid foam. The support members 242 also have holes 256 which engage with pins.

Figure 8A:
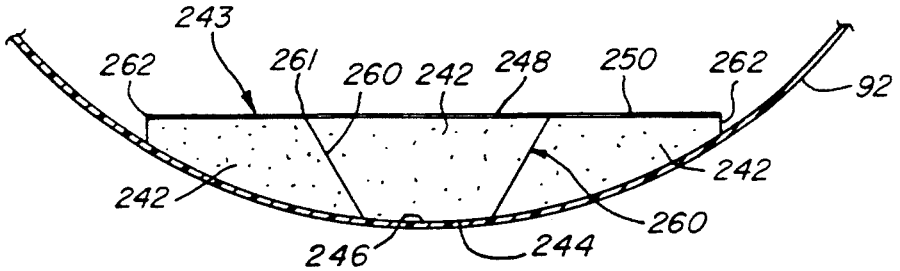
FIG. 8A–B are front cross-sectional views of the floor system intact (A) and after impact (B)
Figure 8B:
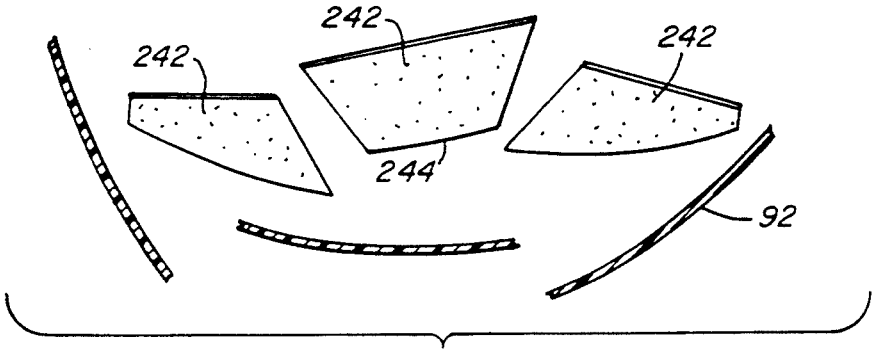

The construction of the support members can be understood more clearly in connection with FIG. 8A. For a double curvature azimuth antenna enclosure, support members 242 are curved on their undersides 244 (see FIG. 8A), and rest directly on the concave surface 246 of the bottom 92 of the enclosure 90. Similarly, for elevation antenna enclosures the support members 242 the rest on the bottom 112 of the enclosure. The support members 242 can be loosely connected to the surface of the bottom of the enclosure using sections of double faced tape, or possibly a small bracket attached to the base panel. A thin sheet of laminate material 248 (drawn out of scale for the sake of clarity), which is similar to the laminate material of the panel construction is bonded to the top surface 250 of each support element 243 to protect the foam from powdering due to contact with the panels 240. The laminate also connects the foam support members 242 to form the support elements 243 and is provided with a weakened portion 261 at the joining portions 260 of adjacent support members. The support members 242 also have a maximum dimension less than the predetermined fixed breakage size (e.g. four feet). The edges 260 of adjacent blocks are preferably tapered or beveled to help them pick up and over each other upon impact as shown in FIG. 8B.

Figure 9A:
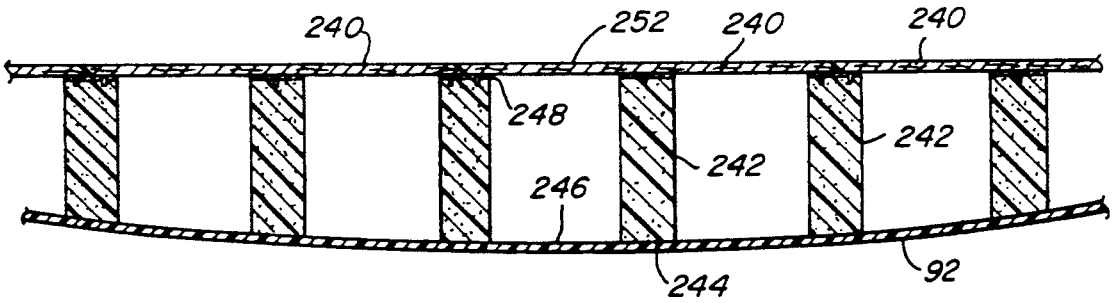
FIGS. 9A–B are side cross sectional views of the floor system intact (A) and after impact (B)

Referring now to FIG. 9A, the floor panels 240, also having a maximum dimension of at most the predetermined fixed breakage size, are preferably constructed of plywood with a non-skid flooring (not shown) bonded to the upper face 252 of the panel. Short shear pins 254

Figure 9B:
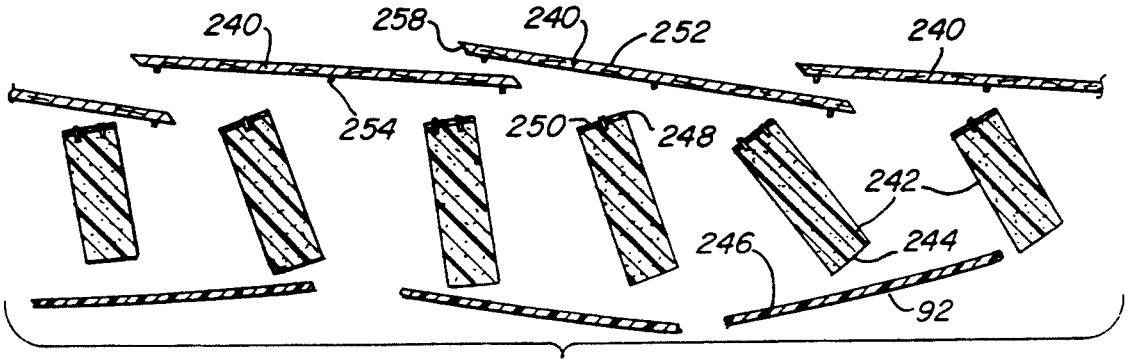

(see FIG. 9B) on the underside of the floor panels 240 engage the holes 256 in the support numbers 242 to locate and stabilize those members relative to the panels 240. The edges 258 of adjacent panels are preferably beveled to facilitate the panels kicking up and over each other if struck edge on as shown in FIG. 9B. Lengths of flexible gasket (not shown) optionally can also be attached at the outer edges 262 of the floor panels, seated against the wall of the enclosure, to form a seal between the wall and the floor 66. Such a gasket is similar to standard precast baseboard moldings such as used in homes. The gasket should also be placed in sections having a maximum dimension of four feet.

Figure 10:
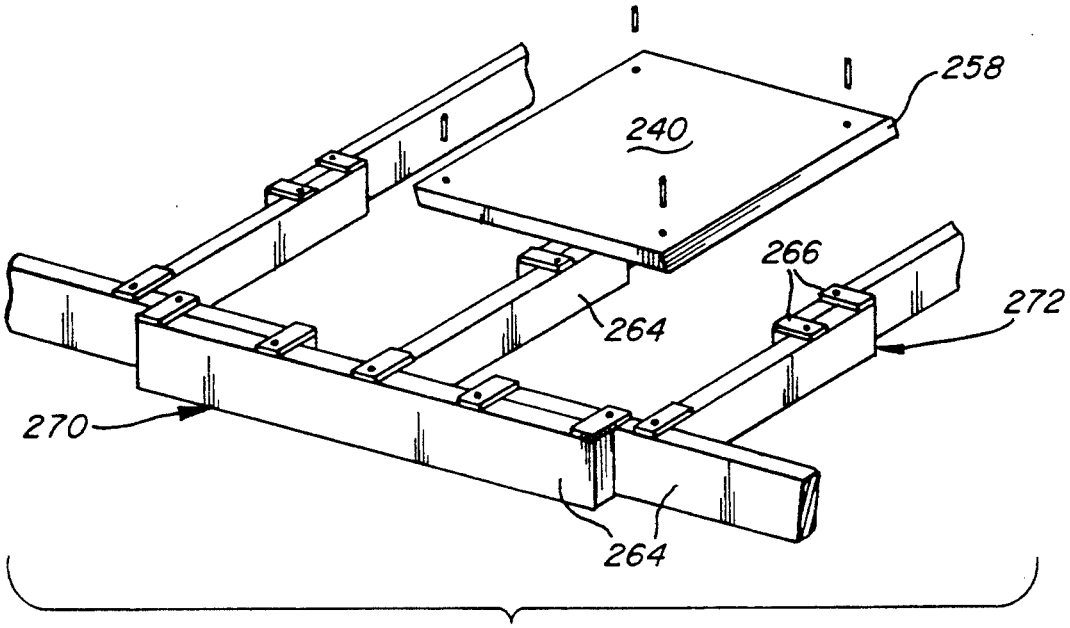
FIG. 10 is an isometric exploded view of an alternate embodiment of the floor system.
Figure 11:
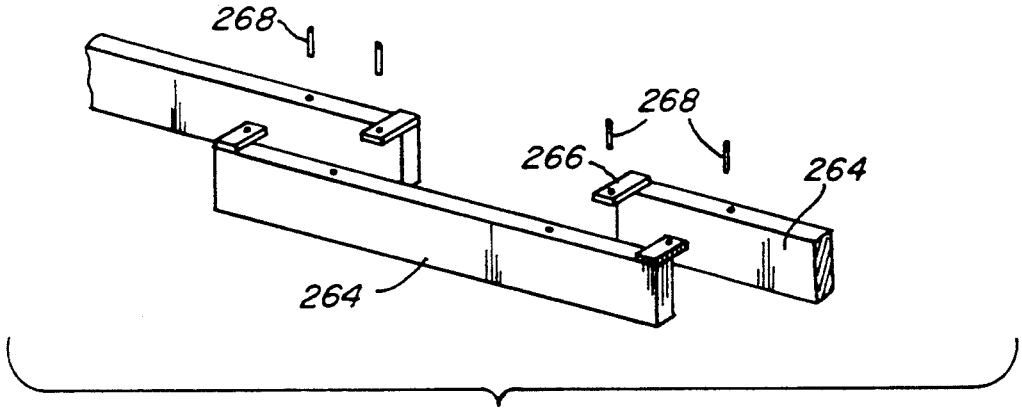
FIG. 11 is an isometric exploded view of the support beams of the alternate floor system.

An alternate embodiment of the floor system 66 will now be discussed in connection with FIGS. 10 and 11. In this embodiment, the floor panels are substantially the same as those in the first embodiment. The support structure shown in FIG. 10 is different in that it comprises a plurality of beams 264, preferably made of aluminum, interconnected with connection plates 266 and shear pins 268 (FIG. 11). A girder 270, formed along one direction, is connected to the support stubs 134 (not shown) of the tower 60, preferably using shear pins as well. The girder, in turn, supports transverse support beams 272 which extend across the enclosure and, in turn, support the floor panels 240. The floor panels 240 need only be loosely connected to the supporting structure of beams 270 and 272. Upon a generally horizontal impact, the shear pins 268 will break, thus causing failure of the support system and collapse of the floor. However, generally vertical loads of personnel and equipment will be supported by this structure.

Having now described a few embodiments of the invention, it should be apparent to those skilled in the art that the foregoing is illustrative only and not limiting, having been presented by way of example only. Numerous other embodiments and modifications thereof are contemplated as falling within the scope of the present invention as defined by the appended claims and equivalents thereto.

What is claimed is:

1. A frangible floor system for a structure, which floor system breaks apart, when subjected to a substantially horizontal impact load, into pieces having a maximum dimension of at most a predetermined fixed size, the floor system comprising:

a plurality of support members each having a maximum dimension of at most the fixed size;

means associating together pluralities of support members, each associated plurality forming a support element;

the structure having means supporting the support elements;

a plurality of floor panels disposed on top of and supported by support elements, the maximum dimension of each floor panel being at most the fixed size;

said support elements having first locating means;

said floor panels having second locating means cooperating with said first locating means for loosely maintaining the position of the floor panels relative to the support elements.

2. A frangible floor system for a structure, which floor system breaks apart, when subjected to a substantially horizontal impact load, into pieces having a maximum dimension of at most a predetermined fixed size, the floor system comprising:

a plurality of support members each having a maximum dimensions of at most the fixed size;

means associating together pluralities of support member, each associated plurality forming a support element;

the structure having means supporting the support elements;

a plurality of floor panels disposed on top of and supported by support elements, the maximum dimension of each floor panel being at most the fixed sized;

said support elements having first locating means;

said floor panels having second locating means cooperating with said first locating means for loosely maintaining the position of the floor panels relative to the support elements, wherein at least selected adjacent pairs of said floor panels have smoothly mating edges, which edges each have at least one bevelled portion smoothly mating against the adjacent floor panel of the pair.

3. A frangible floor system as set forth in claim 2, wherein at least selected adjacent pairs of said support members have smoothly mating edges, which edges each have at least one bevelled portion smoothly mating against the adjacent support member of the pair.

4. A frangible floor system as set forth in claim 3, wherein said means associating pluralities of support members comprises a layer of laminate material.

5. A frangible floor system as set forth in claim 4, wherein said first locating means comprises portions defining a hole, and said second locating means comprises a short pin of a size to be received in the hole.

6. A frangible floor system as set forth in claim 4, wherein said second locating means comprises portions defining a hole, and said first locating means comprises a short pin of a size to be received in the hole.

7. A frangible floor system for a structure, which floor system breaks apart, when subjected to a substantially horizontal impact load, into pieces having a maximum dimension of at most a predetermined fixed size, the floor system comprising:

a plurality of support members each having a maximum dimensions of at most the fixed size;

means associated together pluralities of support members, each associated plurality forming a support element;

the structure having means supporting the support elements;

a plurality of floor panels disposed on top of and supported by support elements, the maximum dimension of each floor panel being at most the fixed size;

said support elements having first locating means;

said floor panels having second locating means cooperating with said first locating means for loosely maintaining the position of the floor panels relative to the support elements, wherein the structure has a plurality of said supporting means, the means for supporting the support elements comprising the supporting means, selected support elements being attached to said supporting means, and remaining support elements being attached to the selected support elements to form a support frame.

8. A frangible floor system as set forth in claim 7, wherein at least selected adjacent pairs of said floor panels have smoothly mating edges, which edges each have at least one bevelled portion smoothly mating against the adjacent floor panel of the pair.

9. A frangible floor system as set forth in claim 8, wherein said means associating pluralities of support members comprises at least one connection plate having one end attached to a support member by a shear pin and an opposite end attached to an associated support member by a shear pin.

10. A frangible floor system as set forth in claim 9, wherein said first locating means comprises portions defining a hole and said second locating means comprises a short pin of a size to be received in the hole.

11. A frangible floor system as set forth in claim 9, wherein said second locating means comprises portions defining a hole and said first locating means comprises a short pin of a size to be received in the hole.

12. A frangible enclosure comprising:

a plurality of panels, means for interconnecting said panels to form a housing, said housing having a curvature whereby distributed loads primarily are resisted by axial stresses in the housing, at least one of said panels having means forming a weakened portion therein, for reducing resistance thereat to flexural loads, whereby said enclosure, when subjected to a large impact load, breaks apart proximate said at least one means forming a weakened portion into a plurality of pieces, each piece having a maximum dimension less than a predetermined fixed size; and a floor system disposed within said enclosure and comprising:

a plurality of support members each having a dimension of at most the fixed size;

means associating together pluralities of support members, each associated plurality forming a support element;

a plurality of floor panels disposed on top of the supported by support elements, the maximum dimension of each floor panel being at most the fixed size;

said support elements having first locating means;

said floor panels having second locating means cooperating with said first locating means for loosely maintaining the position of the floor panels relative to the support elements.

13. A frangible enclosure as set forth in claim 12, wherein the enclosure has a base, and wherein said support elements are supported by the enclosure.

14. A frangible enclosure as set forth in claim 13, wherein said support elements are disposed in a spaced apart relationship in at least one dimension and are not connected to each other for support.

15. A frangible enclosure as set forth in claim 14, wherein at least selected adjacent pairs of said floor panels have smoothly mating edges, which edges each have at least one bevelled portion smoothly mating against the adjacent floor panel of the pair.

16. A frangible enclosure as set forth in claim 15, wherein at least selected adjacent pairs of said support members have smoothly mating edges, which edges each have at least one bevelled portion smoothly mating against the adjacent support member of the pair.

17. A frangible enclosure as set forth in claim 16, wherein said means associating pluralities of support members comprises a layer of laminate material.

18. A frangible enclosure as set forth in claim 17, wherein said first locating means comprises portions defining a hole, and said second locating means comprises a short pin of a size to be received in the hole.

19. A frangible enclosure as set forth in claim 17, wherein said second locating means comprises portions defining a hole, and said first locating means comprises a short pin of a size to be received in the hole.

20. A frangible enclosure as set forth in claim 17, having a plurality of support means for supporting the support elements, selected support elements being attached to said support means, and remaining support elements being attached to the selected support elements to form a support frame.

21. A frangible enclosure as set forth in claim 20, wherein at least selected adjacent pairs of said floor panels have smoothly mating edges, which edges each have at least one bevelled portion smoothly mating against the adjacent floor panel of the pair.

22. A frangible enclosure as set forth in claim 21, wherein said means associating pluralities of support members comprises at least one connection plate having one end attached to a support member by a shear pin and an opposite end attached to an associated support member by a shear pin.

23. A frangible enclosure as set forth in claim 22, wherein said first locating means comprises portions defining a hole, and said second locating means comprises a short pin of a size to be received in the hole.

* * * * *